US009368276B2

(12) United States Patent
Kuniyoshi

(10) Patent No.: US 9,368,276 B2
(45) **Date of Patent: *Jun. 14, 2016**

(54) METHOD FOR PRODUCING R-T-B-BASED SINTERED MAGNETS

(75) Inventor: Futoshi Kuniyoshi, Mishima-gun (JP)
(73) Assignee: HITACHI METALS, LTD., Tokyo (JP)

( * ) Notice: Subject to any disclaimer, the term of this patent is extended or adjusted under 35 U.S.C. 154(b) by 161 days.

This patent is subject to a terminal disclaimer.

(21) Appl. No.: 13/805,466
(22) PCT Filed: Jul. 12, 2011
(86) PCT No.: PCT/JP2011/065837
§ 371 (c)(1),
(2), (4) Date: Dec. 19, 2012
(87) PCT Pub. No.: WO2012/008426
PCT Pub. Date: Jan. 19, 2012
(65) Prior Publication Data
US 2013/0087248 A1 Apr. 11, 2013
(30) Foreign Application Priority Data
Jul. 12, 2010 (JP) ..... 2010-157837
(51) Int. Cl.
*H01F 41/02* (2006.01)
*H01F 7/02* (2006.01)
(Continued)
(52) U.S. Cl.
CPC ..... *H01F 41/0293* (2013.01); *B22F 3/24* (2013.01); *C22C 1/02* (2013.01); *C22C 27/00* (2013.01);
(Continued)
(58) Field of Classification Search
CPC ..... B22F 2998/10; B22F 9/04; B22F 3/24; H01F 1/0577; H01F 41/0293; C22C 38/005; C22C 2202/02
USPC ..... 148/101
See application file for complete search history.

(56) References Cited

U.S. PATENT DOCUMENTS

2008/0286595 A1 11/2008 Yoshimura et al.
2009/0297699 A1 12/2009 Baba et al.
2012/0112863 A1 5/2012 Kuniyoshi

FOREIGN PATENT DOCUMENTS

JP 2004-296973 A 10/2004
JP 2009-194262 A 8/2009

OTHER PUBLICATIONS

Machine translation of JP2004296973, Oct. 2004.*
(Continued)

*Primary Examiner* — Jie Yang
*Assistant Examiner* — Xiaowei Su
(74) *Attorney, Agent, or Firm* — Keating & Bennett, LLP

(57) ABSTRACT

A method for producing a sintered R-T-B based magnet includes the steps of: providing a sintered R-T-B based magnet body 1; providing an RH diffusion source including a heavy rare-earth element RH (which is at least one of Dy and Tb) and 30 mass % to 80 mass % of Fe; loading the sintered R-T-B based magnet body 1 and the RH diffusion source 2 into a processing chamber 3 so that the magnet body 1 and the diffusion source 2 are movable relative to each other and are readily brought close to, or in contact with, each other; and performing an RH diffusion process in which the sintered magnet body 1 and the RH diffusion source 2 are heated to a processing temperature of more than 850° C. through 1000° C. while being moved either continuously or discontinuously in the processing chamber.

8 Claims, 1 Drawing Sheet

(51) Int. Cl.

| | |
|---|---|
| ***B22F 3/24*** | (2006.01) |
| ***C22C 27/00*** | (2006.01) |
| ***C22C 33/02*** | (2006.01) |
| ***C22C 38/00*** | (2006.01) |
| ***H01F 1/057*** | (2006.01) |
| ***C22C 1/02*** | (2006.01) |

(52) U.S. Cl.
CPC ..... *C22C 33/0278* (2013.01); *C22C 38/00* (2013.01); *C22C 38/005* (2013.01); *H01F 1/0577* (2013.01); *H01F 7/02* (2013.01)

(56) References Cited

OTHER PUBLICATIONS

Machine translation of JP2009-194262A. Aug. 2009.*
Official Communication issued in International Patent Application No. PCT/JP2011/065837, mailed on Oct. 11, 2011.
English translation of Official Communication issued in corresponding International Application PCT/JP2011/065837, mailed on Feb. 21, 2013.

* cited by examiner

METHOD FOR PRODUCING R-T-B-BASED SINTERED MAGNETS

TECHNICAL FIELD

The present invention relates to a method for producing a sintered R-T-B based magnet (where R is a rare-earth element and T is a transition metal element, most of which is Fe) including an $R_2T_{14}B$ type compound as its main phase.

BACKGROUND ART

A sintered R—Fe—B based magnet, including an $R_2T_{14}B$ type compound as a main phase, is known as a permanent magnet with the highest performance, and has been used in various types of motors such as a voice coil motor (VCM) for a hard disk drive and a motor for a hybrid car and in numerous types of consumer electronic appliances.

As a sintered R-T-B based magnet loses its coercivity at high temperatures, such a magnet will cause an irreversible flux loss. For that reason, when used in a motor, for example, the magnet should maintain coercivity that is high enough even at elevated temperatures to minimize the irreversible flux loss.

It is known that if R in the $R_2T_{14}B$ type compound phase is replaced with a heavy rare-earth element RH (which may be Dy and/or Tb), the coercivity of a sintered R-T-B based magnet will increase. It is effective to add a lot of such a heavy rare-earth element RH to the sintered R-T-B based magnet to achieve high coercivity at a high temperature.

However, if the light rare-earth element RL (which may be at least one of Nd and Pr) is replaced with the heavy rare-earth element RH as R in a sintered R-T-B based magnet, the coercivity certainly increases but the remanence decreases instead. Furthermore, as the heavy rare-earth element RH is one of rare natural resources, its use should be cut down.

For these reasons, various methods for increasing the coercivity of a sintered R-T-B based magnet effectively with the addition of as small an amount of the heavy rare-earth element RH as possible have recently been researched and developed in order to avoid decreasing the remanence. The applicant of the present application already disclosed, in Patent Document No. 1, a method for diffusing a heavy rare-earth element RH inside of a sintered R—Fe—B based magnet body while supplying the heavy rare-earth element RH onto the surface of the sintered R-T-B based magnet body (which will be referred to herein as an "evaporation diffusion process"). According to Patent Document No. 1, inside of a processing chamber made of a refractory metallic material, the sintered R-T-B based magnet body and an RH bulk body are arranged so as to face each other with a predetermined gap left between them. The processing chamber includes a member for holding multiple sintered R-T-B based magnet bodies and a member for holding the RH bulk body. A method that uses such an apparatus requires a series of process steps of arranging the RH bulk body in the processing chamber, introducing a holding member and a net, putting the sintered R-T-B based magnet bodies on the net, mounting the holding member and the net on the sintered magnet bodies, putting the upper RH bulk body on the net, and sealing the processing chamber hermetically and carrying out an evaporation diffusion.

Patent Document No. 2 discloses that in order to improve the magnetic properties of an R-T-B based intermetallic compound magnetic material, a powder of Yb metal with a low boiling point and a sintered R-T-B based magnet body are sealed and heated in a thermally resistant hermetic container, thereby depositing uniformly a coating of Yb metal on the surface of the sintered R-T-B based magnet body and diffusing a rare-earth element inside of the sintered R-T-B based magnet body from that coating (see, in particular, Example #5 of Patent Document No. 2).

Patent Document No. 3 discloses conducting a heat treatment process with a ferrous compound of a heavy rare-earth compound including Dy or Tb as a heavy rare-earth element attached to a sintered R-T-B based magnet body.

CITATION LIST

Patent Literature

Patent Document No. 1: PCT International Application Publication No. 2007/102391

Patent Document No. 2: Japanese Laid-Open Patent Publication No. 2004-296973

Patent Document No. 3: Japanese Laid-Open Patent Publication No. 2009-289994

SUMMARY OF INVENTION

Technical Problem

According to the method of Patent Document No. 1, the heavy rare-earth element RH can be supplied onto the sintered R-T-B based magnet body at a lower temperature of 700° C. to 1000° C. than when the surface of the sintered R-T-B based magnet body is coated with such an element by sputtering or evaporation process, and therefore, the heavy rare-earth element RH is not supplied excessively onto the sintered R-T-B based magnet body. As a result, a sintered R-T-B based magnet with increased coercivity can be obtained almost without decreasing the remanence. However, the RH bulk body that supplies the heavy rare-earth element RH should be a highly reactive one. That is why if the RH bulk body were heated in contact with the sintered R-T-B based magnet body, then the RH bulk body could react with the sintered R-T-B based magnet body to have its property affected. In addition, since the sintered R-T-B based magnet body and the RH bulk body including the heavy rare-earth element RH need to be arranged in the processing chamber with a gap left between them to avoid causing a reaction between the RH bulk body and the sintered R-T-B based magnet body, it takes a lot of trouble to get the arrangement process done.

On the other hand, according to the method of Patent Document No. 2, if the rare-earth metal in question has as high a saturated vapor pressure as Yb, Eu or Sm, deposition of its coating onto the sintered magnet body and diffusion of that element from the coating can be done by carrying out a heat treatment within the same temperature range (e.g., 800° C. to 850° C.). However, according to Patent Document No. 2, to coat the surface of a sintered R-T-B based magnet body with a deposited film of a rare-earth element with a low vapor pressure such as Dy or Tb, the rare-earth metal in the form of powder should be heated selectively to high temperatures by performing an inductive heating process using an RF heating coil. And to heat Dy or Tb to a higher temperature than the sintered R-T-B based magnet body, Dy or Tb and the sintered R-T-B based magnet body should be spaced apart from each other. That is why according to the basic technical idea and method of Patent Document No. 2, unless Dy or Tb and the sintered R-T-B based magnet body were spaced apart from each other, the RH diffusion source would react with the sintered R-T-B based magnet body to have its property altered as in the method disclosed in Patent Document No. 1. In addition, even if Dy or Tb and the sintered R-T-B based magnet body are spaced apart from each other, a thick coating of Dy or Tb is deposited (to several ten μm or more, for example) on the surface of the sintered R-T-B based magnet body when the Dy or Tb powder is selectively heated to a high temperature. Then, Dy or Tb will diffuse and enter the inside of the main phase crystal grains in the vicinity of the surface of the sintered R-T-B based magnet body, thus causing a decrease in remanence.

According to the method of Patent Document No. 3, as the heat treatment process is carried out with a ferrous alloy powder of Dy or Tb attached to the sintered R-T-B based magnet body, Dy or Tb diffuses from a fixed point of attachment into the sintered R-T-B based magnet body. Since the ferrous alloy of Dy or Tb used is a fine powder with a size of 50 μm to 100 nm, such a fine powder is hard to remove completely and likely to remain in the heat treatment furnace after the heat treatment process. Such a ferrous alloy of Dy or Tb that remains in the furnace after the heat treatment process easily reacts with the sintered R-T-B based magnet body and is likely to turn into a contamination. That is why such a ferrous alloy powder of Dy or Tb as disclosed in Patent Document No. 3 needs to be removed completely from the furnace every time the heat treatment process is carried out, and therefore, is not recyclable repeatedly. On top of that, since the additional process step of dissolving the ferrous alloy powder of Dy or Tb in a solvent or turning the powder into slurry and applying it needs to be performed, it takes a lot of trouble to make a sintered R-T-B based magnet, which is a problem.

The present inventors perfected our invention in order to overcome these problems and an object of the present invention is to provide a method for producing a sintered R-T-B based magnet by diffusing a heavy rare-earth element RH such as Dy or Tb from the surface of a sintered R-T-B based magnet body inside the body without decreasing the remanence so that the magnet can be produced as efficiently as possible by using the same RH diffusion source repeatedly.

Solution to Problem

A method for producing a sintered R-T-B based magnet according to the present invention includes the steps of: providing a sintered R-T-B based magnet body; providing an RH diffusion source including a heavy rare-earth element RH (which is at least one of Dy and Tb) and 30 mass % to 80 mass % of Fe; loading the sintered R-T-B based magnet body and the RH diffusion source into a processing chamber so that the magnet body and the diffusion source are movable relative to each other and are readily brought close to, or in contact with, each other; and performing an RH diffusion process in which the sintered R-T-B based magnet body and the RH diffusion source are heated to a processing temperature of more than 850° C. through 1000° C. while being moved either continuously or discontinuously in the processing chamber.

In one embodiment, the processing temperature is 870° C. to 1000° C.

In one embodiment, the RH diffusion source includes 40 mass % to 80 mass % of Fe.

In one embodiment, the RH diffusion source includes 40 mass % to 60 mass % of Fe.

In one embodiment, the RH diffusion process includes the step of rotating the processing chamber.

In one embodiment, in the RH diffusion process, the processing chamber is rotated at a surface velocity of at least 0.01 m/s.

In one embodiment, the RH diffusion process is carried out with a stirring aid member introduced into the processing chamber.

In one embodiment, the stirring aid member is made of zirconia, silicon nitride, silicon carbide, boron nitride or a ceramic that includes any combination of these compounds.

In one embodiment, in the RH diffusion process, the heat treatment is carried out with the internal pressure of the processing chamber adjusted to a pressure of 0.001 Pa through the atmospheric pressure.

In one embodiment, the method includes the steps of: (A) providing an additional sintered R-T-B based magnet body; and (B) performing an RH diffusion process in which the additional sintered R-T-B based magnet body and the RH diffusion source are loaded into the processing chamber so as to be movable relative to each other and be readily brought close to, or in contact with, each other, and then are heated to a processing temperature of more than 850° C. through 1000° C. while being moved either continuously or discontinuously in the processing chamber.

In one embodiment, by repeatedly performing the steps (A) and (B) a number of times, the heavy rare-earth element RH is diffused from the same RH diffusion source to a plurality of additional sintered R-T-B based magnet bodies.

A sintered R-T-B based magnet according to the present invention is produced by a method for producing a sintered R-T-B based magnet according to any of the embodiments of the present invention described above.

An RH diffusion source according to the present invention is to be used in a method for producing a sintered R-T-B based magnet according to any of the embodiments of the present invention described above. The RH diffusion source includes a heavy rare-earth element RH (which is at least one of Dy and Tb) and 30 mass % to 80 mass % of Fe.

Advantageous Effects of Invention

According to the present invention, an RH diffusion source including a heavy rare-earth element RH (which is at least one of Dy and Tb) and 30 mass % to 80 mass % of Fe can be used repeatedly without having its property altered.

In addition, the RH diffusion source including a heavy rare-earth element RH (which is at least one of Dy and Tb) and 30 mass % to 80 mass % of Fe is loaded into a processing chamber so as to be movable with respect to, and be readily brought close to, or in contact with, a sintered R-T-B based magnet body, and then moved either continuously or discontinuously at a temperature of more than 850° C. through 1000° C. As a result, the RH diffusion process can be carried out without taking too much trouble getting the arrangement done.

DESCRIPTION OF EMBODIMENTS

Figure 1:
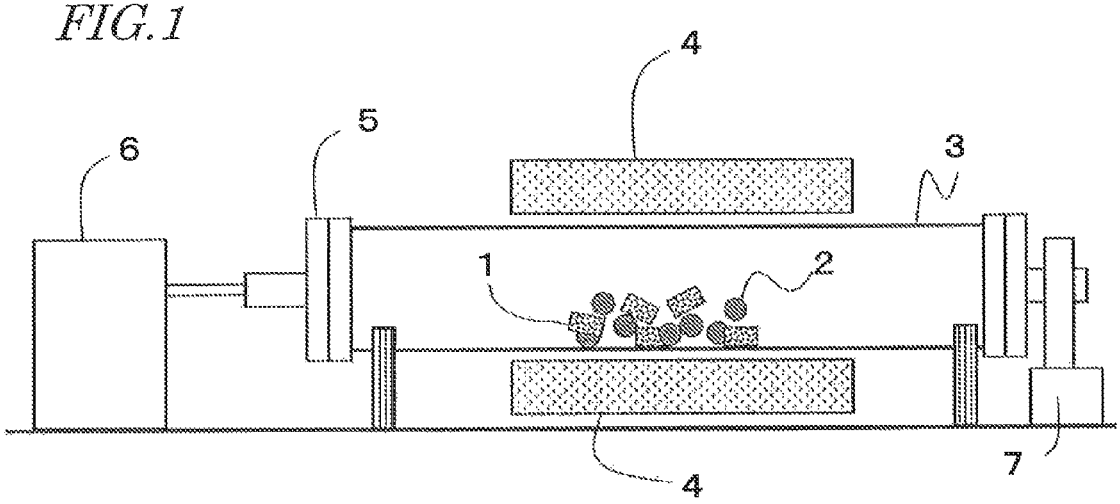
FIG. 1 A cross-sectional view schematically illustrating a configuration for a diffusion system for use in a preferred embodiment of the present invention.

According to the manufacturing process of the present invention, a sintered R-T-B based magnet body and an RH diffusion source are loaded into a processing chamber (or a processing container) so as to be movable relative to each other and brought close to, or in contact with, each other, and then are heated to, and maintained at, a temperature (processing temperature) of more than 850° C. through 1000° C., more suitably a processing temperature of 870° C. through 1000° C. The RH diffusion source is an alloy including a heavy rare-earth element RH (which is at least one of Dy and Tb) and 30 mass % to 80 mass % of Fe. In this case, by rotating, rocking or shaking the processing chamber, the sintered R-T-B based magnet body and the RH diffusion source are moved either continuously or discontinuously in the processing chamber, thereby changing the point of contact between the sintered R-T-B based magnet body and the RH diffusion source. At the same time, the heavy rare-earth element RH can not only be supplied onto the sintered R-T-B based magnet body but also be diffused inside the sintered magnet body simultaneously while the sintered R-T-B based magnet body and the RH diffusion source are either brought close to, or spaced part from, each other. This process step will be referred to herein as an "RH diffusion process step".

In addition, according to the present invention, since the RH diffusion source and the sintered R-T-B based magnet body can be loaded into the processing chamber so as to be movable relative to each other and be brought close to, or in contact with, each other and can be moved either continuously or discontinuously, the time it would otherwise take to arrange the RH diffusion source and the sintered R-T-B based magnet body at predetermined positions can be saved.

By using an alloy including the heavy rare-earth element RH and 30 mass % to 80 mass % of Fe as the RH diffusion source, it is possible to prevent the RH diffusion source from getting altered by Nd or Pr that leaks out of the sintered R-T-B based magnet body during the RH diffusion process.

On top of that, the RH diffusion source of the present invention does not react with the sintered R-T-B based magnet easily. That is why even if the RH diffusion process is carried out at a temperature of more than 850° C. through 1000° C., it is possible to avoid supplying an excessive amount of heavy rare-earth element RH (which is at least one of Dy and Tb) onto the surface of the sintered R-T-B based magnet. As a result, sufficiently high coercivity can be achieved with a decrease in remanence after the RH diffusion process minimized.

In this case, if Fe accounted for less than 30 mass % of the RH diffusion source, then the volume percentage of the heavy rare-earth element RH would increase so much that Nd or Pr leaking out of the sintered R-T-B based magnet body during the RH diffusion process would be absorbed into the RH diffusion source and react with Fe, thus shifting the composition of the RH diffusion source and altering its property.

On the other hand, if Fe accounted for more than 80 mass %, then the RH content would be less than 20 mass %, the amount of the heavy rare-earth element RH supplied from the RH diffusion source would decrease, and it would take a very long time to get the diffusion process done. That is why in order to mass produce the magnets, it is not appropriate to use that high Fe content.

According to the present invention, by moving the RH diffusion source, including the heavy rare-earth element RH and 30 mass % to 80 mass % of Fe, along with the sintered R-T-B based magnet body either continuously or discontinuously at a temperature of more than 850° C. through 1000° C., the heavy rare-earth element RH can be introduced through the surface, and diffused inside, of the sintered R-T-B based magnet body at a point of contact between the RH diffusion source and the sintered R-T-B based magnet body in the processing chamber. Since that temperature range of more than 850° C. to 1000° C. is a temperature range in which RH diffusion is promoted in the sintered R-T-B based magnet body, the RH diffusion process can be carried out when the heavy rare-earth element RH can easily diffuse inside of the sintered R-T-B based magnet body. The RH diffusion can be carried out more efficiently at a temperature of 870° C. to 1000° C.

The mass percentage of Fe included in the RH diffusion source of the present invention is suitably 40 mass % to 80 mass %, and more suitably 40 mass % to 60 mass %. In the latter range, the volume percentage of an $RHFe_2$ compound such as $DyFe_2$, and/or an $RHFe_3$ compound such as $DyFe_3$, and/or an $RH_6Fe_{23}$ compound such as $Dy_6Fe_{23}$ included in the RH diffusion source becomes 90% or more.

In a combination of a rare-earth element and Fe, if the rare-earth element is Nd or Pr, no 1-2, 1-3 or 6-23 compound, of which the (Nd or Pr) to Fe atomic number ratio is 1:2, 1:3 or 6:23, is produced. Consequently, in the more suitable range, if the RH diffusion source has a composition ratio of 1-2, 1-3 or 6-23, it is possible to prevent the RH—Fe compound in the RH diffusion source from absorbing Nd or Pr leaking out of the sintered R-T-B based magnet body during the RH diffusion process. As a result, the RH diffusion source never gets altered and can be used repeatedly an even larger number of times.

In addition, the heavy rare-earth element RH is never supplied excessively onto the sintered R-T-B based magnet body and the remanence $B_r$ no longer decreases in the RH diffusion process.

As for a method for moving the sintered R-T-B based magnet body and the RH diffusion source in the processing chamber either continuously or discontinuously during the RH diffusion process, as long as the RH diffusion source and the sintered R-T-B based magnet body can have their relative positions changed without making the sintered R-T-B based magnet body chip or fracture, any arbitrary method may be used. For example, the processing chamber may be rotated, rocked or subjected to externally applied vibrations. Alternatively, stirring means may be provided in the processing chamber. Still alternatively, the processing chamber may be fixed and stirring means arranged in the processing chamber may change the relative positions of the RH diffusion source and the sintered R-T-B based magnet body.

If the magnetocrystalline anisotropy of a sintered R-T-B based magnet is increased on the outer periphery of its main phase crystal grains by forming a heavy rare-earth element replaced layer on the outer periphery of the main phase with the heavy rare-earth element RH diffused from outside of the main phase crystal grains, the coercivity $H_{cJ}$ of the entire magnet is said to increase effectively. According to the present invention, the heavy rare-earth element replaced layer can be formed on the outer periphery of the main phase not just in a region close to the surface of the sintered R-T-B based magnet body but also in a region deep under the surface of the sintered R-T-B based magnet body. That is why by forming such a layer including the heavy rare-earth element RH in an increased concentration efficiently on the outer periphery of the main phase over the entire sintered R-T-B based magnet body, not just the coercivity $H_{cJ}$ can be increased but also the remanence $B_r$ hardly decreases because the heavy rare-earth element replaced layer is so thin that a portion with a low heavy rare-earth element RH concentration remains in the core of the main phase.

According to the present invention, the composition of the sintered R-T-B based magnet body does not have to include the heavy rare-earth element RH. That is to say, a known sintered R-T-B based magnet body, including a light rare-earth element RL (which is at least one of Nd and Pr) as a rare-earth element R, is provided and the heavy rare-earth element RH is diffused inside of the magnet from its surface. According to the present invention, by producing a grain boundary diffusion of the heavy rare-earth element RH, the heavy rare-earth element RH can also be supplied efficiently to the outer periphery of the main phase that is located deep inside of the sintered R-T-B based magnet body. The present invention is naturally applicable to a sintered R-T-B based magnet to which the heavy rare-earth element RH has already been added. However, if a lot of heavy rare-earth element RH were added, the effects of the present invention would not be achieved sufficiently. That is why a relatively small amount of the heavy rare-earth element RH should be added in that case.

In a preferred embodiment, performed are the step (A) of providing an additional sintered R-T-B based magnet body and the step (B) of performing an RH diffusion process in which the additional sintered R-T-B based magnet body and the RH diffusion source are loaded into the processing chamber so as to be movable relative to each other and be readily brought close to, or in contact with, each other, and then are heated to a processing temperature of more than 850° C. through 1000° C. while being moved either continuously or discontinuously in the processing chamber. Optionally, by repeatedly performing the steps (A) and (B) a number of times, the heavy rare-earth element RH may be diffused from the same RH diffusion source to a plurality of additional sintered R-T-B based magnet bodies.

In this description, the "additional sintered R-T-B based magnet body" refers herein to a sintered R-T-B based magnet body which is different from the sintered R-T-B based magnet body that has been subjected to the RH diffusion process last time using the same RH diffusion source. Also, "by diffusing the heavy rare-earth element RH to a plurality of additional sintered R-T-B based magnet bodies" means sequentially performing the same RH diffusion process on a number of sintered R-T-B based magnet bodies which have not been subjected to the RH diffusion process yet, thereby making sintered R-T-B based magnets in which the heavy rare-earth element RH has been diffused one after another.

Sintered R-T-B Based Magnet Body

First of all, according to the present invention, a sintered R-T-B based magnet body in which the heavy rare-earth element RH needs to diffuse is provided. The sintered R-T-B based magnet body provided in the present invention has a known composition and may have a composition including:

- 12 to 17 at % of a rare-earth element R;
- 5 to 8 at % of B (a portion of which may be replaced with C);
- 0 to 2 at % of an additive element M (which is at least one element selected from the group consisting of Al, Ti, V, Cr, Mn, Ni, Cu, Zn, Ga, Zr, Nb, Mo, Ag, In, Sn, Hf, Ta, W, Pb and Bi); and
- T (which is a transition metal consisting mostly of Fe but which may include Co) and inevitable impurities as the balance.

In this case, most of the rare-earth element R is at least one element that is selected from the light rare-earth elements RL (Nd and Pr) but that may include a heavy rare-earth element as well. The heavy rare-earth element suitably includes at least one of Dy and Tb.

The sintered R-T-B based magnet body may be produced by a known manufacturing process.

Hereinafter, the diffusion process step to be performed on the sintered R-T-B based magnet body will be described in detail.

RH Diffusion Source

The RH diffusion source is an alloy including a heavy rare-earth element RH and 30 mass % to 80 mass % of Fe, and may have any arbitrary shape (e.g., in the form of a ball, a wire, a plate, a block or powder). If the RH diffusion source has a ball shape or a wire shape, its diameter may be set to be a few millimeters to several centimeters. But if the RH diffusion source has a powder shape, its particle size may fall within the range of 0.05 mm to 5 mm. In this manner, the shape and size of the RH diffusion source are not particularly limited.

The RH diffusion sources may be made by not only an ordinary alloy production process but also a diffusion reduction process, for example.

If the RH diffusion process is repeatedly performed using the same RH diffusion source, sometimes Nd may be introduced from the sintered R-T-B based magnet body into the RH diffusion source. However, even if Nd is introduced but as long as the composition of the RH diffusion source falls within the range specified above, that RH diffusion source can be used repeatedly in the manufacturing process of the present invention. In this description, the "same RH diffusion source" may refer to an RH diffusion source, of which the composition still falls within that range even if its composition, shape and weight have changed by going through the RH diffusion process a number of times. In other words, even if the composition, shape and weight of an RH diffusion source have changed but unless the function of the RH diffusion source is lost, the RH diffusion source can maintain its identity.

It should be noted that even if Nd has been introduced, the composition of the RH diffusion source will vary only slightly through a single RH diffusion process. That is why even if Nd has been introduced, the maximum number of times that the RH diffusion source can be used repeatedly does not decrease significantly.

Unless the effects of the present invention are lessened, the RH diffusion source may include not only Dy, Tb and Fe but also at least one element selected from the group consisting of Nd, Pr, La, Ce, Zn, Zr, Sn and Co.

In addition, the RH diffusion source may further include, as inevitable impurities, at least one element selected from the group consisting of Al, Ti, V, Cr, Mn, Ni, Cu, Ga, Nb, Mo, Ag, In, Hf, Ta, W, Pb, Si and Bi.

Stirring Aid Member

In an embodiment of the present invention, it is recommended that a stirring aid member, as well as the sintered R-T-B based magnet body and the RH diffusion source, be introduced into the processing chamber. The stirring aid member plays the roles of promoting the contact between the RH diffusion source and the sintered R-T-B based magnet body and indirectly supplying the heavy rare-earth element RH that has been once deposited on the stirring aid member itself to the sintered R-T-B based magnet body. Added to that, the stirring aid member also prevents chipping due to a collision between the sintered R-T-B based magnet bodies or between the sintered R-T-B based magnet body and the RH diffusion source in the processing chamber.

The stirring aid member suitably has a shape that makes it easily movable in the processing chamber. And it is effective to rotate, rock or shake the processing chamber by combining that stirring aid member with the sintered R-T-B based magnet body and the RH diffusion source. Such a shape that makes the stirring aid member easily movable may be a sphere, an ellipsoid, or a circular cylinder with a diameter of several hundred μm to several ten mm.

The stirring aid member is suitably made of a material that does not react easily with the sintered R-T-B based magnet body or the RH diffusion source even if the member contacts with the sintered R-T-B based magnet body or the RH diffusion source during the RH diffusion process. The stirring aid member may be made of zirconia, silicon nitride, silicon carbide, boron nitride or a ceramic that includes any combination of these compounds. Alternatively, the stirring aid member may also be made of an element belonging to the group including Mo, W, Nb, Ta, Hf and Zr or a mixture thereof.

RH Diffusion Process

Hereinafter, a typical example of a diffusion process according to the present invention will be described with reference to FIG. 1.

In the example illustrated in FIG. 1, sintered R-T-B based magnet bodies 1 and RH diffusion sources 2 have been loaded into a cylinder 3 of stainless steel. Although not shown in FIG. 1, it is recommended that zirconia balls be introduced as stirring aid members into the cylinder 3. In this example, the cylinder 3 functions as the processing chamber. The cylinder 3 does not have to be made of stainless steel but may also be made of any other arbitrary material as long as the material has thermal resistance that is high enough to withstand a temperature of more than 850° C. to 1000° C. and hardly reacts with the sintered R-T-B based magnet bodies 1 or the RH diffusion sources 2. For example, the cylinder 3 may also be made of Nb, Mo, W or an alloy including at least one of these elements. Alternatively, the cylinder 3 may also be made of an Fe—Cr—Al based alloy or an Fe—Cr—Co based alloy. The cylinder 3 has a cap 5 that can be opened and closed or removed. Optionally, projections may be arranged on the inner wall of the cylinder 3 so that the RH diffusion sources and the sintered R-T-B based magnet bodies can move and contact with each other efficiently. A cross-sectional shape of the cylinder 3 as viewed perpendicularly to its longitudinal direction does not have to be circular but may also be elliptical, polygonal or any other arbitrary shape. In the example illustrated in FIG. 1, the cylinder 3 is connected to an exhaust system 6. The exhaust system 6 can increase or decrease the pressure inside of the cylinder 3. An inert gas such as Ar may be introduced from a gas cylinder (not shown) into the cylinder 3.

The cylinder 3 is heated by a heater 4, which is arranged around the outer periphery of the cylinder 3. When the cylinder 3 is heated, the sintered R-T-B based magnet bodies 1 and the RH diffusion sources 2 that are housed inside the cylinder 3 are also heated. The cylinder 3 is supported rotatably on its center axis and can also be rotated by a motor 7 even while being heated by the heater 4. The rotational velocity of the cylinder 3, which is represented by a surface velocity at the inner wall of the cylinder 3, may be set to be 0.01 m per second or more. The rotational velocity of the cylinder 3 is suitably set to be 0.5 m per second or less so as to prevent the sintered R-T-B based magnet bodies in the cylinder from colliding against each other violently and chipping due to the rotation.

In the example illustrated in FIG. 1, the cylinder is supposed to be rotating. However, according to the present invention, as long as the sintered R-T-B based magnet bodies 1 and the RH diffusion sources 2 are movable relative to each other and can contact with each other in the cylinder 3 during the RH diffusion process, the cylinder 3 does not always have to be rotated but may also be rocked or shaken. Or the cylinder 3 may even be rotated, rocked and/or shaken in combination.

Next, it will be described how to carry out an RH diffusion process using the processing apparatus shown in FIG. 1.

First of all, the cap 5 is removed from the cylinder 3, thereby opening the cylinder 3. And after multiple sintered R-T-B based magnet bodies 1 and RH diffusion sources 2 have been loaded into the cylinder 3, the cap 5 is attached to the cylinder 3 again. Then the inner space of the cylinder 3 is evacuated with the exhaust system 6 connected. When the internal pressure of the cylinder 3 becomes sufficiently low, the exhaust system 6 is disconnected. After that, the cylinder 3 is heated by the heater 4 while being rotated by the motor 7.

During the diffusion heat treatment, an inert atmosphere is suitably maintained in the cylinder 3. In this description, the "inert atmosphere" refers to a vacuum or an inert gas. Also, the "inert gas" may be a rare gas such as argon (Ar) gas but may also be any other gas as long as the gas is not chemically reactive between the sintered magnet bodies 1 and the RH diffusion sources 2. The pressure of the inert gas is suitably equal to, or lower than, the atmospheric pressure. If the pressure of the atmospheric gas inside the cylinder 3 were close to the atmospheric pressure, then the heavy rare-earth element RH would not be supplied easily from the RH diffusion sources 2 onto the surface of the sintered R-T-B based magnet bodies 1 according to the technique disclosed in Patent Document No. 1. However, since the RH diffusion sources 2 and the sintered R-T-B based magnet bodies 1 are arranged either close to, or in contact with, each other, according to this embodiment, the RH diffusion process can be carried out at a higher pressure than in Patent Document No. 1. Also, there is relatively weak correlation between the degree of vacuum and the amount of RH supplied. Thus, even if the degree of vacuum were further increased, the amount of the heavy rare-earth element RH supplied (and eventually the degree of increase in coercivity) would not change significantly. The amount supplied is more sensitive to the temperature of the sintered R-T-B based magnet bodies than the pressure of the atmosphere.

In this embodiment, the processing chamber in which the RH diffusion sources 2 including the heavy rare-earth element RH and the sintered R-T-B based magnet bodies 1 are put together is heated while being rotated, thereby supplying the heavy rare-earth element RH from the RH diffusion sources 2 onto the surface of the sintered R-T-B based magnet bodies 1 and diffusing the heavy rare-earth element RH inside of the sintered magnet bodies at the same time.

During the diffusion process, the surface velocity at the inner wall of the processing chamber may be set to be 0.01 m/s or more, for example. If the rotational velocity were too low, the point of contact between the sintered R-T-B based magnet bodies and the RH diffusion sources would shift so slowly as to cause sticking between them easily. That is why the higher the diffusion temperature, the higher the rotational velocity of the processing chamber should be. A suitable rotational velocity varies according to not just the diffusion temperature but also the shape and size of the RH diffusion source as well.

In this embodiment, the temperature of the RH diffusion sources 2 and the sintered R-T-B based magnet bodies is maintained within the range of more than 850° C. to 1000° C. This is a proper temperature range for the heavy rare-earth element RH to diffuse inward in the internal structure of the sintered R-T-B based magnet bodies 1 through the grain boundary phase.

Each of the RH diffusion sources 2 includes the heavy rare-earth element RH and 30 mass % through 80 mass % of Fe. And the heavy rare-earth element RH would not be supplied excessively when the heat treatment temperature is higher than 850° C. and equal to or lower than 1000° C. The heat treatment process may be carried out for 10 minutes to 72 hours, and suitably for 1 to 12 hours.

In addition, the RH diffusion source 2 hardly gets altered. Particularly when the volume percentage of $RHFe_2$ or $RHFe_3$ accounts for most of the RH diffusion source 2, Nd or Pr leaking out of the sintered R-T-B based magnet body 1 will not be absorbed into the RH—Fe compound in the RH diffusion source 2. As a result, the RH diffusion source does not get altered and can be used repeatedly. In this description, if "the RH diffusion source gets altered", it means that the RH diffusion source has had its composition, shape and weight changed too significantly to maintain its intended function or to preserve its identity.

If the process temperature were higher than 1000° C., the RH diffusion sources 2 and the sintered R-T-B based magnet bodies 1 would easily stick to each other. On the other hand, if the process temperature were equal to or lower than 850 AD, then it would take too much time to carry out the process.

The amount of time for maintaining that temperature is determined by the ratio of the total volume of the sintered R-T-B based magnet bodies 1 loaded to that of the RH diffusion sources 2 loaded during the RH diffusion process, the shape of the sintered R-T-B based magnet bodies 1, the shape of the RH diffusion sources 2, the rate of diffusion of the heavy rare-earth element RH into the sintered R-T-B based magnet bodies 1 through the RH diffusion process (which will be referred to herein as a "diffusion rate") and other factors.

The pressure of the atmospheric gas during the RH diffusion process (i.e., the pressure of the atmosphere inside the processing chamber) may be set to fall within the range of 0.001 Pa through the atmospheric pressure.

Optionally, after the RH diffusion process, the sintered R-T-B based magnet bodies 1 may be subjected to a first additional heat treatment process in order to distribute more uniformly the heavy rare-earth element RH diffused or diffuse the heavy rare-earth element RH even deeper. In that case, after the RH diffusion sources have been removed, the additional heat treatment process is carried out within the temperature range of 700° C. to 1000° C. in which the heavy rare-earth element RH can diffuse substantially, more suitably within the range of 850° C. to 950° C. In this first heat treatment process, no heavy rare-earth element RH is further supplied onto the sintered R-T-B based magnet bodies 1 but the heavy rare-earth element RH does diffuse inside of the sintered R-T-B based magnet bodies 1. As a result, the heavy rare-earth element RH diffusing can reach deep inside under the surface of the sintered R-T-B based magnet bodies, and the magnets as a whole can eventually have increased coercivity. The first heat treatment process may be carried out for a period of time of 10 minutes to 72 hours, for example, and suitably for 1 to 12 hours. In this case, the pressure of the atmosphere in the heat treatment furnace where the first heat treatment process is carried out is equal to, or lower than, the atmospheric pressure and is suitably 100 kPa or less.

Second Heat Treatment Process

Also, if necessary, a second heat treatment process may be further carried out at a temperature of 400° C. to 700° C. However, if the second heat treatment process (at 400° C. to 700° C.) is conducted, it is recommended that the second heat treatment be carried out after the first heat treatment (at 700° C. to 1000° C.). The first heat treatment process (at 700° C. to 1000° C.) and the second heat treatment process (at 400° C. to 700° C.) may be performed in the same processing chamber. The second heat treatment process may be performed for a period of time of 10 minutes to 72 hours, and suitably performed for 1 to 12 hours. In this case, the pressure of the atmosphere in the heat treatment furnace where the second heat treatment process is carried out is equal to, or lower than, the atmospheric pressure and is suitably 100 kPa or less.

EXPERIMENTAL EXAMPLE 1

First of all, a sintered R-T-B based magnet body, having a composition consisting of 30.0 mass % of Nd, 0.5 mass % of Dy, 1.0 mass % of B, 0.9 mass % of Co, 0.1 mass % of Al, 0.1 mass % of Cu, and Fe as the balance, was made. Next, the sintered magnet body was machined, thereby obtaining cubic sintered R-T-B based magnet bodies with a size of 7.4 mm×7.4 mm×7.4 mm. The magnetic properties of the sintered R-T-B based magnet bodies thus obtained were measured with a B-H tracer after the heat treatment (at 500° C.). As a result, the sintered R-T-B based magnet bodies had a coercivity $H_{cJ}$ of 1000 kA/m and a remanence $B_r$ of 1.42 T.

Next, an RH diffusion process was carried out using the machine shown in FIG. 1. The cylinder had a volume of 128000 $mm^3$, the weight of the sintered R-T-B based magnet bodies loaded was 50 g, and the weight of the RH diffusion sources loaded was 50 g. As the RH diffusion sources, spherical ones with a diameter of 3 mm or less were used.

Figure 2:
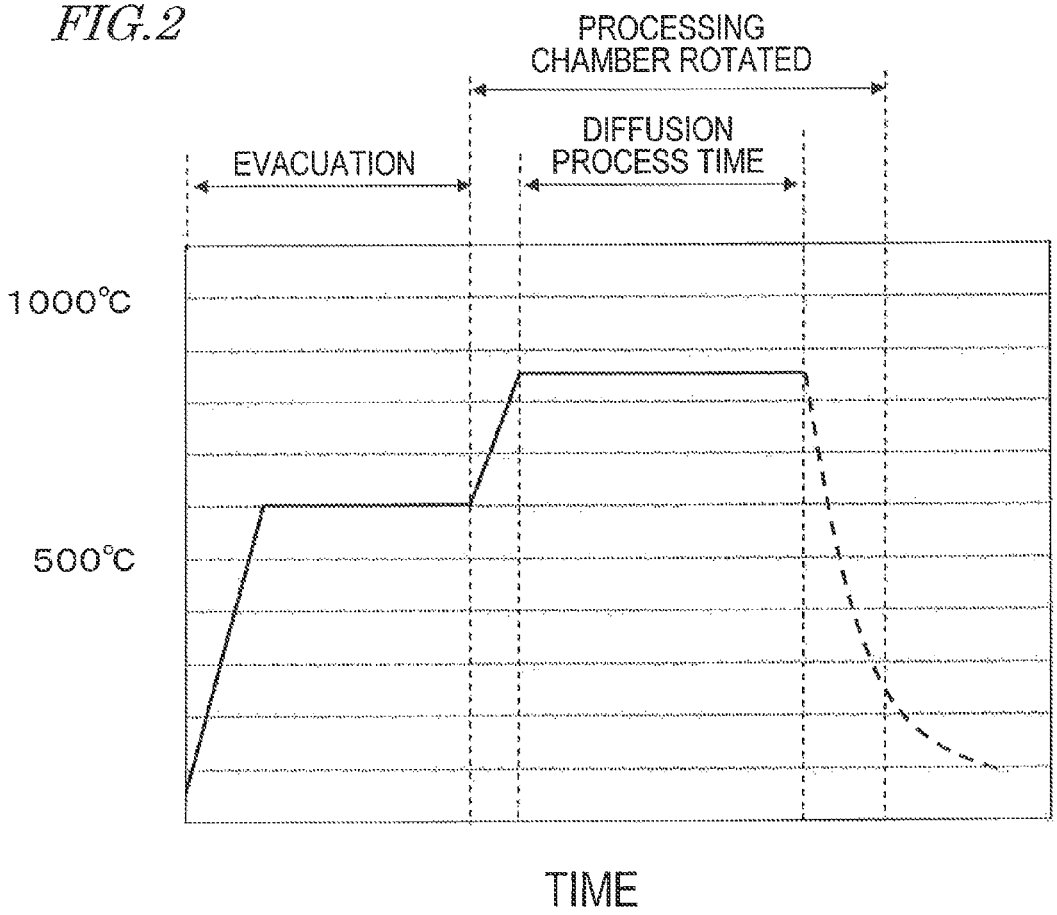
FIG. 2 A graph showing an example of a heat pattern to adopt in a diffusion process.

In the diffusion process, the temperature in the processing chamber changed as shown in FIG. 2, which is a graph showing a heat pattern that represents how the temperature in the processing chamber changed after the heating process was started. In the example illustrated in FIG. 2, evacuation was carried out while the temperature was being raised by a heater at a temperature increase rate of approximately 10° C. per minute. Next, until the pressure in the processing chamber reaches a predetermined level, the temperature was maintained at about 600° C. Thereafter, the processing chamber started to be rotated, and the temperature was raised to a diffusion process temperature at a temperature increase rate of approximately 10° C. per minute. When the diffusion process temperature was reached, that temperature was maintained for a predetermined period of time. Thereafter, the heating process by the heater was stopped and the temperature was lowered to around room temperature. After that, the sintered R-T-B based magnet bodies were unloaded from the machine shown in FIG. 1, loaded into another heat treatment furnace, subjected to the first heat treatment process at the same atmospheric gas pressure as in the diffusion process (at 800° C. to 950° C.×4 to 6 hours), and then subjected to the second heat treatment process after the diffusion process (at 450° C. to 550° C.×3 to 5 hours). In this case, the process temperatures and times of the first and second heat treatment processes were set with the weights of the sintered R-T-B based magnet bodies and RH diffusion sources loaded, the composition of the RH diffusion sources, and the RH diffusion temperature taken into account.

The RH diffusion process was carried out using various RH diffusion sources (representing Samples #1 through #18) with their Dy, Tb and Fe contents changed. The results are shown in the following Table 1. For the purpose of comparison, similar experiments were carried out on Samples #19 through #22 using a diffusion source of the element Dy metal, a diffusion source of the element Tb metal, and an alloy including Dy and 20 mass % of Fe was used as RH diffusion sources. In this case, the sintered R-T-B based magnet body had its each side ground by 0.2 mm after the diffusion process to be machined into a cubic shape of 7.0 mm×7.0 mm×7.0 mm, and then had its magnetic properties measured with a B-H tracer. In Table 1, the "RH diffusion source" column shows the composition and size of the RH diffusion source that was used in the diffusion process. The "surface velocity" column tells the surface velocity at the inner wall of the cylinder 3 shown in FIG. 1. The "RH diffusion temperature" column indicates the temperature in the cylinder 3 that was maintained in the diffusion process. The "RH diffusion time" column indicates how long the RH diffusion temperature was maintained. The "atmospheric gas pressure" column indicates the pressure when the diffusion process was started. The degree of increase in coercivity $H_{cJ}$ as a result of the RH diffusion process is indicated by "$\Delta J_{cJ}$" and the degree of increase in remanence $B_r$ as a result of the RH diffusion process is indicated by "$\Delta B_r$". A negative numerical value indicates that the magnetic property decreased compared to the sintered R-T-B based magnet body yet to be subjected to the RH diffusion process.

TABLE 1

| Sample | RH diffusion source Dy (mass %) | Tb | Fe | Size (mm) | Surface velocity (m/s) | RH diffusion temperature (° C.) | RH diffusion process time (hr) | Atmospheric gas pressure (Pa) | $\Delta H_{cJ}$ (kA/m) | $\Delta B_r$ (T) |
|---|---|---|---|---|---|---|---|---|---|---|
| 1 | 70 | 0 | 30 | ≤3 | 0.02 | 900 | 6 | 0.5 | 430 | −0.005 |
| 2 | 60 | 0 | 40 | ≤3 | 0.02 | 900 | 6 | 0.5 | 430 | 0 |
| 3 | 60 | 0 | 40 | ≤3 | 0.02 | 900 | 6 | 100 | 420 | 0 |
| 4 | 60 | 0 | 40 | ≤3 | 0.02 | 900 | 3 | 0.5 | 250 | 0 |
| 5 | 60 | 0 | 40 | ≤3 | 0.02 | 900 | 6 | 100000 | 390 | 0 |
| 6 | 55 | 0 | 45 | ≤3 | 0.02 | 900 | 6 | 0.5 | 430 | 0 |
| 7 | 55 | 0 | 45 | ≤3 | 0.02 | 870 | 6 | 0.5 | 300 | 0 |
| 8 | 55 | 0 | 45 | ≤3 | 0.02 | 970 | 6 | 0.5 | 450 | — |
| 9 | 55 | 0 | 45 | ≤3 | 0.02 | 1020 | 6 | 0.5 | — | 0 |
| 10 | 55 | 0 | 45 | ≤3 | 0.02 | 800 | 6 | 0.5 | 50 | 0 |
| 11 | 55 | 0 | 45 | ≤3 | 0.02 | 900 | 10 | 0.5 | 430 | 0 |
| 12 | 50 | 0 | 50 | ≤3 | 0.02 | 900 | 6 | 0.5 | 410 | 0 |
| 13 | 40 | 0 | 60 | ≤3 | 0.02 | 900 | 3 | 2 | 250 | 0 |
| 14 | 40 | 0 | 60 | ≤3 | 0.02 | 900 | 6 | 0.5 | 400 | 0 |
| 15 | 25 | 0 | 75 | ≤3 | 0.02 | 900 | 6 | 0.5 | 200 | 0 |
| 16 | 20 | 0 | 80 | ≤3 | 0.02 | 900 | 6 | 0.5 | 180 | 0 |
| 17 | 0 | 60 | 40 | ≤3 | 0.02 | 900 | 6 | 0.5 | 780 | 0 |
| 18 | 30 | 30 | 40 | ≤3 | 0.02 | 900 | 6 | 0.5 | 620 | 0 |
| 19 | 100 | 0 | 0 | ≤5 | 0.02 | 820 | 6 | 0.5 | 320 | −0.02 |
| 20 | 100 | 0 | 0 | ≤5 | 0.02 | 900 | 6 | 0.5 | — | — |
| 21 | 0 | 100 | 0 | ≤5 | 0.02 | 820 | 6 | 0.5 | 600 | −0.02 |
| 22 | 80 | 0 | 20 | ≤5 | 0.02 | 820 | 6 | 0.5 | 300 | −0.01 |

As can be seen from Table 1, in the range of the present invention (i.e., if the RH diffusion source included the heavy rare-earth element RH and 30 mass % to 80 mass % of Fe), the decrease in remanence could be reduced to 0.005 T or less and the coercivity increased. Also, as can be seen from the result obtained for Samples #3 and #5, the effects of the present invention could also be achieved even when the atmospheric gas pressure was high.

Also, the results shown in Table 1 reveal that in the range of the present invention, comparing Samples #1, #2, #6, #12 and #14 through #16 that had been subjected to the RH diffusion process under the same condition except the composition of the RH diffusion source, the increase in coercivity ($\Delta H_{cJ}$) was significant and the remanence did not decrease in Samples #2, #6, #12 and #14 that had been subjected to the RH diffusion process using a Dy—Fe alloy including 60 mass % to 40 mass % of Dy and 40 mass % to 60 mass % of Fe. It was also discovered that in Sample #17 which had been subjected to the RH diffusion process using a Tb—Fe alloy including 60 mass % of Tb and 40 mass % of Fe, the increase in coercivity ($\Delta H_{cJ}$) was also significant and the remanence did not decrease, either. It was further discovered that in Sample #18 which had been subjected to the RH diffusion process using a Dy—Tb—Fe alloy including 30 mass % of Dy, 30 mass % of Tb and 40 mass % of Fe, the increase in coercivity ($\Delta H_{cJ}$) was also significant and the remanence did not decrease, either.

On the other hand, when an RH diffusion source consisting of the element Dy metal was used (Sample #19), when an RH diffusion source consisting of the element Tb metal was used (Sample #21), and when an RH diffusion source made of an alloy including Dy and 20 mass % of Fe was used (Sample #22), the coercivity did increase but the remanence decreased by as much as 0.02 T. Also, if the RH diffusion temperature was set to be 900° C. as in Sample #20, the sintered R-T-B based magnet bodies and the RH diffusion sources stuck to each other.

It was also discovered that even when an RH diffusion process was carried out using an alloy including 60 mass % to 40 mass % of Dy and 40 mass % to 60 mass % of Fe, the sintered magnet bodies and RH diffusion sources still stuck to each other in Sample #9 once the RH diffusion temperature exceeded 1000° C.

EXPERIMENTAL EXAMPLE 2

The RH diffusion process and the first heat treatment process were carried out under the same condition as in Experimental Example 1 described above except that a sphere of zirconia with a diameter of 5 mm and a weight of 50 g was added as a stirring aid member, and the magnetic properties were measured. The results are shown in the following Table 2.

As can be seen from Table 2, even though the RH diffusion process was carried out on Samples #23, #24, #26, #27, #28, #29, #30, #31, #32 and #33 for only a half as long a time as on Samples #1, #2, #5, #6, #12, #14, #15, #16, #17 and #18, $H_{cJ}$ could be increased significantly in a short time and $B_r$ hardly decreased. Comparing Samples #24, #25 and #26 to each other, it was discovered that the effect of the present invention could be achieved significantly even when the atmospheric gas pressure was high.

Also, comparing Sample #24 in Table 2 to Sample #4 in Table 1, it was discovered that $\Delta H_{cJ}$ could be increased with a sphere of zirconia with a diameter of 5 mm introduced. This is probably because the sphere of zirconia functioning as a stirring aid member would have promoted contact between the RH diffusion sources and the sintered R-T-B based magnet bodies and would have supplied the heavy rare-earth element RH that had been deposited on itself onto the sintered R-T-B based magnet bodies indirectly.

On top of that, chipping occurred much less often than in Samples #1, #2, #5, #6, #12, #14, #15, #16, #17 and #18.

TABLE 2

| Sample | RH diffusion source Dy (mass %) | Tb | Fe | Size (mm) | Surface velocity (m/s) | RH diffusion temperature (° C.) | RH diffusion time (hr) | Atmospheric gas pressure (Pa) | $\Delta H_{cJ}$ (kA/m) | $\Delta B_r$ (T) | Stirring aid member |
|---|---|---|---|---|---|---|---|---|---|---|---|
| 23 | 70 | 0 | 30 | ≤3 | 0.02 | 900 | 3 | 0.5 | 430 | −0.005 | YES |
| 24 | 60 | 0 | 40 | ≤3 | 0.02 | 900 | 3 | 0.5 | 430 | 0 | YES |
| 25 | 60 | 0 | 40 | ≤3 | 0.02 | 950 | 3 | 2 | 420 | 0 | YES |
| 26 | 60 | 0 | 40 | ≤3 | 0.02 | 900 | 3 | 100000 | 390 | 0 | YES |
| 27 | 55 | 0 | 45 | ≤3 | 0.02 | 900 | 3 | 0.5 | 430 | 0 | YES |
| 28 | 50 | 0 | 50 | ≤3 | 0.02 | 900 | 3 | 0.5 | 410 | 0 | YES |
| 29 | 40 | 0 | 60 | ≤3 | 0.02 | 900 | 3 | 0.5 | 400 | 0 | YES |
| 30 | 25 | 0 | 75 | ≤3 | 0.02 | 900 | 3 | 0.5 | 200 | 0 | YES |
| 31 | 20 | 0 | 80 | ≤3 | 0.02 | 900 | 3 | 0.5 | 180 | 0 | YES |
| 32 | 0 | 60 | 40 | ≤3 | 0.02 | 900 | 6 | 0.5 | 780 | 0 | YES |
| 33 | 30 | 30 | 40 | ≤3 | 0.02 | 900 | 3 | 0.5 | 620 | 0 | YES |

EXPERIMENTAL EXAMPLE 3

The following Table 3 shows what $\Delta H_{cJ}$ and $\Delta B_r$ values were obtained when the RH diffusion process was repeatedly carried out five, ten, thirty and fifty times under the experimental conditions for Samples #2, #6, #12, #14, #19 and #22. In Table 3, Samples #34, #35, #36, #37, #38 and #39 were subjected to the RH diffusion process under the conditions for Samples #2, #6, #12, #14, #19 and #22, respectively.

$B_r$ and $H_{cJ}$ of the sintered magnets that had been subjected to the RH diffusion process were measured with a B-H tracer. As a result, even if those samples were repeatedly subjected to the RH diffusion process five, ten, thirty or fifty times under the conditions for Samples #34 through #37 falling within the range of the present invention, their magnetic properties were not different from those of Samples #2, #6, #12 and #14 shown in Table 1. It was discovered that as neither $\Delta H_{cJ}$ nor $\Delta B_r$ changed, the RH diffusion sources would not have been altered so significantly as to affect the magnetic properties of the sintered R-T-B based magnet bodies during the RH diffusion process.

As for Samples #38 and #39, on the other hand, as they were subjected to the same RH diffusion process five, ten, thirty and fifty times, their coercivity could be increased less and less effectively than in Samples #19 and #22 shown in Table 1. It was discovered that as $\Delta H_{cJ}$ and $\Delta B_r$ changed, the RH diffusion sources should have been altered so significantly as to affect the magnetic properties of the sintered R-T-B based magnet bodies during the RH diffusion process.

TABLE 3

| Sample | Used 5 times $\Delta H_{cJ}$ (kA/m) | $\Delta B_r$ (T) | Used 10 times $\Delta H_{cJ}$ (kA/m) | $\Delta B_r$ (T) | Used 30 times $\Delta H_{cJ}$ (kA/m) | $\Delta B_r$ (T) | Used 50 times $\Delta H_{cJ}$ (kA/m) | $\Delta B_r$ (T) |
|---|---|---|---|---|---|---|---|---|
| 34 | 430 | 0 | 430 | 0 | 430 | 0 | 430 | 0 |
| 35 | 430 | 0 | 430 | 0 | 430 | 0 | 430 | 0 |
| 36 | 410 | 0 | 410 | 0 | 410 | 0 | 410 | 0 |
| 37 | 400 | 0 | 400 | 0 | 400 | 0 | 400 | 0 |
| 38 | 300 | −0.02 | 260 | −0.02 | 240 | −0.03 | 200 | −0.03 |
| 39 | 280 | −0.01 | 250 | −0.01 | 220 | −0.02 | 190 | −0.02 |

As can be seen from these results, if RH diffusion sources including 30 mass % to 80 mass % of Fe and sintered R-T-B based magnet bodies are brought into contact with each other in the heated processing chamber and if their points of contact are not fixed, the heavy rare-earth element RH can be introduced effectively into the grain boundary of the sintered magnet bodies by a method that contributes to mass production, and eventually the magnetic properties can be improved.

EXPERIMENTAL EXAMPLE 4

First of all, a sintered R-T-B based magnet body, having a composition consisting of 29.0 mass % of Nd, 1.5 mass % of Pr, 1.0 mass % of B, 0.9 mass % of Co, 0.2 mass % of Al, 0.1 mass % of Cu, and Fe as the balance, was made. Next, the sintered magnet body was machined, thereby obtaining cubic sintered R-T-B based magnet bodies with a size of 7.4 mm×7.4 mm×7.4 mm. The magnetic properties of the sintered R-T-B based magnet bodies thus obtained were measured with a B-H tracer after the heat treatment (at 500° C.×1 hr). As a result, the sintered R-T-B based magnet bodies had an $H_{cJ}$ of 860 kA/m and a $B_r$ of 1.40 T. These values were used as reference for evaluating the performances of the respective experimental examples to be described below.

The RH diffusion sources were made by weighing Dy, Tb, and Fe so that these elements had the predetermined composition shown in the following Table 4, melting them in an induction melting furnace, bringing the melt into contact with a copper water cooled roller rotating at a roller surface velocity of 2 m/s to obtain a melt-quenched alloy, pulverizing the alloy with a stamp mill or by hydrogen decrepitation process, and then adjusting the particle sizes to 3 mm or less using a sieve.

Next, an RH diffusion process was carried out using the machine shown in FIG. 1. The cylinder had a volume of 128000 $mm^3$, the weight of the sintered R-T-B based magnet bodies loaded was 50 g, and the weight of the RH diffusion sources loaded was 50 g. As the RH diffusion sources, ones with indefinite shapes with a diameter of 3 mm or less were used.

The RH diffusion process was carried out by introducing argon gas into the processing chamber, which had already been evacuated, and raising the pressure inside the chamber to 5 Pa and then heating the chamber with the heater 4 until the RH diffusion temperature (of 820° C.) was reached while rotating the processing chamber. Even if the pressure varied while the temperature was being increased, the pressure was maintained at 5 Pa by either releasing or supplying the Ar gas appropriately. The temperature increase rate was approximately 10° C. per minute. After the RH diffusion process was carried out at various temperatures of 700° C., 800° C., 870° C., 900° C., 970° C., 1000° C. and 1020° C., the heating process was stopped to lower the temperature to room temperature. Subsequently, after the RH diffusion sources were unloaded from the machine shown in FIG. 1, the sintered R-T-B based magnet bodies remaining in the chamber were subjected to the first heat treatment process (at 900° C. for three hours) under Ar at an atmospheric gas pressure of 5 Pa and then subjected to the second heat treatment process (at 500° C. for one hour) after the diffusion.

In this example, the sintered R-T-B based magnet body had its each side ground by 0.2 mm after the RH diffusion process to be machined into a cubic shape of 7.0 mm×7.0 mm×7.0 mm, and then had its magnetic properties measured with a B-H tracer. In Table 4, if the "sticking occurred?" column says "YES", it indicates that the RH diffusion sources stuck to the sintered R-T-B based magnets after having been subjected to the RH diffusion process.

If the RH diffusion process was carried out at multiple different temperatures (of 700° C., 800° C., 870° C., 900° C., 970° C., 1000° C. and 1020° C.), sticking sometimes occurred and sometimes not as shown in the following Table 4.

Samples #40 through #52 used the RH diffusion sources of the present invention, while Samples #53 through #61 are comparative examples.

As can be seen from Table 4, in Samples #41 through #46 and #48 through #52, sticking did not occur in the range of 870° C. to 1000° C.

Even if the RH diffusion sources of the present invention were used but if the RH diffusion process was carried out at 1020° C., sticking occurred in Samples #40 and #47. That is why the RH diffusion process should be carried out at 1000° C. or less.

As can be seen from the results obtained for Samples #41 through #44 and #48 through #50, according to the present invention, high $\Delta H_{cJ}$ could be obtained by carrying out the RH diffusion process within the range of 870° C. to 1000° C.

On the other hand, if the element Dy metal was used as diffusion source, sticking occurred at 870° C., 900° C. and 1000° C. as in Samples #53 to #55. And if the diffusion process was carried out using the element Tb metal as a diffusion source, sticking occurred at 870° C. and 900° C. as in Samples #58 and #59.

TABLE 4

| Sample | RH diffusion source Dy (mass %) | Tb | Fe (mm) | Surface velocity (m/s) | RH diffusion temperature (° C.) | RH diffusion process time (hr) | Atmospheric gas pressure (Pa) | $\Delta H_{cJ}$ (kA/m) | $\Delta B_r$ (T) | Sticking occurred? |
|---|---|---|---|---|---|---|---|---|---|---|
| 40 | 60 | — | 40 | 0.04 | 1020 | 5 | 5 | — | — | YES |
| 41 | 60 | — | 40 | 0.04 | 1000 | 5 | 5 | 440 | 0 | NO |
| 42 | 60 | — | 40 | 0.04 | 970 | 5 | 5 | 440 | 0 | NO |
| 43 | 60 | — | 40 | 0.04 | 900 | 5 | 5 | 420 | 0 | NO |
| 44 | 60 | — | 40 | 0.04 | 870 | 5 | 5 | 310 | 0 | NO |
| 45 | 60 | — | 40 | 0.04 | 800 | 5 | 5 | 130 | 0 | NO |
| 46 | 60 | — | 40 | 0.04 | 700 | 5 | 5 | 80 | 0 | NO |
| 47 | — | 60 | 40 | 0.04 | 1020 | 5 | 5 | — | — | YES |
| 48 | — | 60 | 40 | 0.04 | 970 | 5 | 5 | 750 | 0 | NO |
| 49 | — | 60 | 40 | 0.04 | 900 | 5 | 5 | 720 | 0 | NO |
| 50 | — | 60 | 40 | 0.04 | 870 | 5 | 5 | 700 | 0 | NO |
| 51 | — | 60 | 40 | 0.04 | 800 | 5 | 5 | 360 | 0 | NO |
| 52 | — | 60 | 40 | 0.04 | 700 | 5 | 5 | 170 | 0 | NO |
| 53 | 100 | — | — | 0.04 | 1000 | 5 | 5 | — | — | YES |
| 54 | 100 | — | — | 0.04 | 900 | 5 | 5 | — | — | YES |
| 55 | 100 | — | — | 0.04 | 870 | 5 | 5 | — | — | YES |
| 56 | 100 | — | — | 0.04 | 800 | 5 | 5 | 210 | 0 | NO |
| 57 | 100 | — | — | 0.04 | 700 | 5 | 5 | 90 | 0 | NO |
| 58 | — | 100 | — | 0.04 | 900 | 5 | 5 | — | — | YES |
| 59 | — | 100 | — | 0.04 | 870 | 5 | 5 | — | — | YES |
| 60 | — | 100 | — | 0.04 | 800 | 5 | 5 | 520 | 0 | NO |
| 61 | — | 100 | — | 0.04 | 700 | 5 | 5 | 190 | 0 | NO |

EXPERIMENTAL EXAMPLE 5

Sintered R-T-B based magnets were made under the same condition and by the same method as in Experimental Example 4 except the condition shown in the following Table 5.

To measure the effect of an atmospheric gas pressure during the RH diffusion process, the RH diffusion process was carried out at various atmospheric gas pressures as shown in the following Table 5. As a result, $H_{cJ}$ increased irrespective of the pressure as long as the atmospheric gas pressure fell within the range of 0.001 Pa through 100000 Pa (i.e., in Samples #62 through #71).

TABLE 5

| Sample | RH diffusion source Dy (mass %) | Tb | Fe | Surface velocity (m/s) | RH diffusion temperature (° C.) | RH diffusion process time (hr) | Atmospheric gas pressure (Pa) | $\Delta H_{cJ}$ (kA/m) | $\Delta B_r$ (T) |
|---|---|---|---|---|---|---|---|---|---|
| 62 | 60 | — | 40 | 0.02 | 930 | 6 | 1 | 450 | 0 |
| 63 | 60 | — | 40 | 0.02 | 930 | 6 | 2 | 450 | 0 |

TABLE 5-continued

| Sample | RH diffusion source Dy (mass %) | Tb | Fe | Surface velocity (m/s) | RH diffusion temperature (° C.) | RH diffusion process time (hr) | Atmospheric gas pressure (Pa) | $\Delta H_{cJ}$ (kA/m) | $\Delta B_r$ (T) |
|---|---|---|---|---|---|---|---|---|---|
| 64 | 60 | — | 40 | 0.02 | 930 | 6 | 5 | 450 | 0 |
| 65 | 60 | — | 40 | 0.02 | 930 | 6 | 10 | 450 | 0 |
| 66 | 60 | — | 40 | 0.02 | 930 | 6 | 100 | 430 | 0 |
| 67 | 60 | — | 40 | 0.02 | 930 | 6 | 100000 | 420 | 0 |
| 68 | — | 50 | 50 | 0.03 | 910 | 6 | 0.001 | 710 | 0 |
| 69 | — | 50 | 50 | 0.03 | 910 | 6 | 0.01 | 710 | 0 |
| 70 | — | 50 | 50 | 0.03 | 910 | 6 | 0.1 | 710 | 0 |
| 71 | — | 50 | 50 | 0.03 | 910 | 6 | 10 | 710 | 0 |

EXPERIMENTAL EXAMPLE 6

Sintered R-T-B based magnets were made under the same condition and by the same method as in Experimental Example 4 except the condition shown in the following Table 6.

To measure the effect of the surface velocity of the RH diffusion process vessel during the RH diffusion process, the RH diffusion process was carried out with the surface velocity changed as shown in the following Table 6. As a result, when the RH diffusion process was carried out at 920° C., the effect of increasing $H_{cJ}$ hardly changed even if the surface velocity was changed within the range of 0.01 m/s through 0.50 m/s (i.e., in Samples #72 through #77).

TABLE 6

| Sample | RH diffusion source Dy (mass %) | Tb | Fe | Surface velocity (m/s) | RH diffusion temperature (° C.) | RH diffusion process time (hr) | Atmospheric gas pressure (Pa) | $\Delta H_{cJ}$ (kA/m) | $\Delta B_r$ (T) |
|---|---|---|---|---|---|---|---|---|---|
| 72 | 55 | — | 45 | 0.01 | 920 | 5 | 2 | 430 | 0 |
| 73 | 55 | — | 45 | 0.05 | 920 | 5 | 2 | 430 | 0 |
| 74 | 55 | — | 45 | 0.10 | 920 | 5 | 2 | 430 | 0 |
| 75 | 55 | — | 45 | 0.20 | 920 | 5 | 2 | 430 | 0 |
| 76 | 55 | — | 45 | 0.40 | 920 | 5 | 2 | 430 | 0 |
| 77 | 55 | — | 45 | 0.50 | 920 | 5 | 2 | 430 | 0 |

EXPERIMENTAL EXAMPLE 7

Sintered R-T-B based magnets were made under the same condition and by the same method as in Experimental Example 4 except the condition shown in the following Table 7.

The RH diffusion process was carried out using RH diffusion sources with various Dy—Fe ratios by changing the Dy content in the order of 80 mass %, 70 mass %, 60 mass %, 55 mass %, 50 mass %, 40 mass %, 30 mass %, 20 mass %, 10 mass %, and 100 mass % and then the magnetic properties were measured. The results are as shown in the following Table 7.

TABLE 7

| Sample | RH diffusion source Dy (mass %) | Tb | Fe | Surface velocity (m/s) | RH diffusion temperature (° C.) | RH diffusion process time (hr) | Atmospheric gas pressure (Pa) | $\Delta H_{cJ}$ (kA/m) | $\Delta B_r$ (T) |
|---|---|---|---|---|---|---|---|---|---|
| 78 | 80 | — | 20 | 0.03 | 930 | 7 | 5 | — | — |
| 79 | 70 | — | 30 | 0.03 | 930 | 7 | 5 | 470 | −0.01 |
| 80 | 60 | — | 40 | 0.03 | 930 | 7 | 5 | 470 | 0 |
| 81 | 55 | — | 45 | 0.03 | 930 | 7 | 5 | 470 | 0 |
| 82 | 50 | — | 50 | 0.03 | 930 | 7 | 5 | 460 | 0 |
| 83 | 40 | — | 60 | 0.03 | 930 | 7 | 5 | 460 | 0 |
| 84 | 30 | — | 70 | 0.03 | 930 | 7 | 5 | 250 | 0 |

TABLE 7-continued

| Sample | RH diffusion source Dy (mass %) | Tb | Fe | Surface velocity (m/s) | RH diffusion temperature (° C.) | RH diffusion process time (hr) | Atmospheric gas pressure (Pa) | $\Delta H_{cJ}$ (kA/m) | $\Delta B_r$ (T) |
|---|---|---|---|---|---|---|---|---|---|
| 85 | 20 | — | 80 | 0.03 | 930 | 7 | 5 | 220 | 0 |
| 86 | 10 | — | 90 | 0.03 | 930 | 7 | 5 | 50 | 0 |
| 87 | 100 | — | — | 0.03 | 930 | 7 | 5 | — | — |

In Samples #79 through #85 in which the RH diffusion process was carried out at 930° C. for seven hours using RH diffusion sources including 20 mass % to 70 mass % of Dy, $\Delta H_{cJ}$ increased. Among other things, in Samples #80 through #83 with a Dy content of 60 mass % to 40 mass %, a high $\Delta H_{cJ}$ could be obtained without decreasing $B_r$ and good magnetic properties were realized.

In Sample #79, a high $H_{cJ}$ could be obtained but $B_r$ decreased by 0.01 T.

In Samples #84 and #85, $B_r$ did not decrease but $\Delta H_{cJ}$ did not increase as much as in Samples 80 to 83.

On the other hand, in Samples #78 and #87, sticking occurred and the magnetic properties could not be measured. In Sample #86, $\Delta H_{cJ}$ increased only slightly to 50 kA/m.

EXPERIMENTAL EXAMPLE 8

Sintered R-T-B based magnets were made under the same condition and by the same method as in Experimental Example 4 except the condition shown in the following Table 8.

The RH diffusion process was carried out using RH diffusion sources with various Tb—Fe ratios by changing the Tb content in the order of 80 mass %, 70 mass %, 60 mass %, 55 mass %, 50 mass %, 40 mass %, 30 mass %, 20 mass %, 10 mass %, and 100 mass % and then the magnetic properties were measured. The results are as shown in the following Table 8.

TABLE 8

| Sample | RH diffusion source Dy (mass %) | Tb | Fe | Surface velocity (m/s) | RH diffusion temperature (° C.) | RH diffusion process time (hr) | Atmospheric gas pressure (Pa) | $\Delta H_{cJ}$ (kA/m) | $\Delta B_r$ (T) |
|---|---|---|---|---|---|---|---|---|---|
| 88 | — | 80 | 20 | 0.02 | 930 | 5 | 5 | — | — |
| 89 | — | 70 | 30 | 0.02 | 930 | 5 | 5 | 730 | −0.01 |
| 90 | — | 60 | 40 | 0.02 | 930 | 5 | 5 | 730 | 0 |
| 91 | — | 55 | 45 | 0.02 | 930 | 5 | 5 | 730 | 0 |
| 92 | — | 50 | 50 | 0.02 | 930 | 5 | 5 | 720 | 0 |
| 93 | — | 40 | 60 | 0.02 | 930 | 5 | 5 | 720 | 0 |
| 94 | — | 30 | 70 | 0.02 | 930 | 5 | 5 | 390 | 0 |
| 95 | — | 20 | 80 | 0.02 | 930 | 5 | 5 | 290 | 0 |
| 96 | — | 10 | 90 | 0.02 | 930 | 5 | 5 | 70 | 0 |
| 97 | — | 100 | — | 0.02 | 930 | 5 | 5 | — | — |

In Samples #89 through #95 in which the RH diffusion process was carried out at 930° C. for five hours using RH diffusion sources including 20 mass % to 70 mass % of Tb, high $\Delta H_{cJ}$ could be obtained. Among other things, in Samples #90 through #93 with a Tb content of 60 mass % to 40 mass %, a high $\Delta H_{cJ}$ could be obtained without decreasing $B_r$ and good magnetic properties were realized.

In Sample #89, a high $H_{cJ}$ could be obtained but $B_r$ decreased by 0.01 T.

In Samples #94 and #95, $B_r$ did not decrease but $\Delta H_{cJ}$ did not increase as much as in Samples 90 to 93.

On the other hand, in Samples #88 and #97, sticking occurred and the magnetic properties could not be measured. In Sample #96, $\Delta H_{cJ}$ increased only slightly to 70 kA/m.

The heat pattern that can be adopted in the diffusion process of the present invention does not have to be the example shown in FIG. 2 but may be any of various other patterns. Also, the vacuum evacuation may be performed until the diffusion process gets done and the sintered magnet body gets cooled sufficiently.

INDUSTRIAL APPLICABILITY

According to the present invention, a sintered R-T-B based magnet can be produced so that its remanence and coercivity are both high. The sintered magnet body of the present invention can be used effectively in various types of motors such as a motor for a hybrid car to be exposed to high temperatures and in numerous kinds of consumer electronic appliances.

REFERENCE SIGNS LIST

1 sintered R-T-B based magnet body
2 RH diffusion source
3 cylinder made of stainless steel (processing chamber)
4 heater
5 cap
6 exhaust system

The invention claimed is:

1. A method for producing a sintered R-T-B based magnet, the method comprising the steps of:

providing a sintered R-T-B based magnet body;

providing a solid RH diffusion source including a heavy rare-earth element RH (which is at least one of Dy and Tb) and 40 mass % to 60 mass % of Fe, the solid RH diffusion source having a solid physical shape;

loading the sintered magnet body and the solid RH diffusion source into a processing chamber so that the magnet body and the solid RH diffusion source are movable relative to each other and are readily brought in contact with each other; and performing an RH diffusion process in which the sintered magnet body and the solid RH diffusion source are heated to a processing temperature of more than 850° C. through 1000° C. while being moved either continuously or discontinuously in the processing chamber, and changing a point of contact between the sintered magnet body and the solid RH diffusion source by rotating the processing chamber; wherein the RH diffusion process is carried out with a stirring aid member introduced into the processing chamber, the stirring aid member being made of zirconia, silicon nitride, silicon carbide, boron nitride or a ceramic that includes any combination of zirconia, silicon nitride, silicon carbide, and boron nitride; and the sintered magnet body, the solid RH diffusion source and the stirring aid member are stirred in the processing chamber during the RH diffusion process.

2. The method of claim 1, wherein the processing temperature is 870° C. to 1000° C.

3. The method of one of claim 1, wherein in the RH diffusion process, the processing chamber is rotated at a surface velocity of at least 0.01 m/s.

4. The method of claim 1, wherein in the RH diffusion process, the heat treatment is carried out with the internal pressure of the processing chamber adjusted to a pressure of 0.001 Pa through the atmospheric pressure.

5. The method of one of claim 1, comprising the steps of:

(A) providing an additional sintered R-T-B based magnet body; and (B) performing an RH diffusion process in which the additional sintered R-T-B based magnet body and the solid RH diffusion source are loaded into the processing chamber so as to be movable relative to each other and be readily brought close to, or in contact with, each other, and then are heated to a processing temperature of more than 850° C. through 1000° C. while being moved either continuously or discontinuously in the processing chamber.

6. The method of claim 5, wherein by repeatedly performing the steps (A) and (B) a number of times, the heavy rare-earth element RH is diffused from the same solid RH diffusion source to a plurality of additional sintered R-T-B based magnet bodies.

7. The method of claim 1, wherein the RH diffusion process is performed by heating the processing chamber by a heater and then heating the sintered R-T-B based magnet and the solid RH diffusion source.

8. The method of claim 1, wherein the solid RH diffusion source is a ball, a wire, a plate, a block, or a powder particle.

* * * * *